US005139009A

United States Patent [19]

Walsh

[11] Patent Number: 5,139,009

[45] Date of Patent: Aug. 18, 1992

[54] EXHAUST VENTILATION CONTROL SYSTEM

[76] Inventor: Leo B. Walsh, 2152 Middlesex Rd., Columbus, Ohio 43220

[21] Appl. No.: 596,022

[22] Filed: Oct. 11, 1990

[51] Int. Cl.[5] ..... F24C 15/20

[52] U.S. Cl. ..... 126/299 R; 126/299 D; 454/67

[58] Field of Search ..... 126/299 D, 42, 299 R, 126/299 E; 98/115.3

[56] References Cited

U.S. PATENT DOCUMENTS 2,182,106 12/1939 Ames ..... 126/42
3,690,245 9/1972 Ferlise .
4,105,015 8/1978 Isom .
4,121,199 10/1978 Young .
4,352,349 10/1982 Yoho .
4,825,848 5/1989 Macias ..... 126/299 D
4,887,587 12/1989 Deutsch .
4,903,685 2/1990 Melink .

*Primary Examiner*—Larry Jones

*Attorney, Agent, or Firm*—Killworth, Gottman, Hagan & Schaeff

[57] ABSTRACT

An exhaust ventilation control system for use with a ventilation system located at a cooking station and having one or more exhaust fans for exhausting air containing cooking by-products from the cooking station to an external environment, can alter operation of the exhaust fans to match the exhaust requirements to the cooking load. The exhaust ventilation control system includes an exhaust control connected to the exhaust fans for controlling operation of the exhaust fans in response to operation of the cooking areas. The exhaust control requires monitoring of a cooking area for determining which of the one or more cooking areas is in operation, a power control circuit responsive to the cooking are a monitor for controlling power supplied to the exhaust fan motors, and a timed switch operable in response to the power control circuit to switch to a variety of positions, depending on the number of cooking areas in operation.

11 Claims, 2 Drawing Sheets

EXHAUST VENTILATION CONTROL SYSTEM

BACKGROUND OF THE INVENTION

The present invention relates generally to commercial and institutional kitchen exhaust systems and, more particularly, to a device for controlling the exhaust fan above a burner, griddle or fryer. The cooking process of grilling or frying food generates substantial amounts of heat and cooking by-products such as grease particles, smoke and odors. In order to comply with local municipal codes as well as assuring health, safety, and cleanliness of the kitchen facilities, the heated and contaminated air is conventionally removed through an exhaust ventilation system. In a commercial cooking establishment, the exhaust ventilation system generally includes a vented hood extending over the area in which the food is grilled or fried and an exhaust fan motor for drawing the smoke and the like from the vented hood and up through the ventilation ducting to the exterior of the building.

Conventional exhaust systems draw a considerable quantity of air from the interior of the building along with the unwanted cooking odors and smoke. As a result, the air heated or cooled by the air conditioning system of the building is also exhausted to the outside, causing the thermostat of the air conditioner to run the air conditioner to replace the exhausted air. The resultant inefficient operation of the air conditioning system creates an added expense of operation for the owner of the building through higher utility bills, and it wastes valuable energy.

Numerous attempts have been made in the past to overcome the problems associated with exhaust ventilation systems. One approach has been to install a fresh air blower with an exhaust vent located near the cooking station, so that a quantity of outside air is blown into the cooking area to be exhausted along with the cooking by-products, thereby reducing the amount of air conditioning air exhausted. Such a system has proven unsatisfactory in periods of extreme hot or cold outside temperatures, since the introduction of such air into the interior of the building offsets the air conditioning system, causing it to run more often and consume more energy.

Other systems have been developed for automatically operating a cooking area ventilation system in response to detecting cooking by-products emitted from the cooking area, such as U.S. Pat. Nos. 4,121,199 and 3,690,245. Another system is controlled automatically by the presence of a cook at a cooking station. However, such prior devices are not entirely adequate to overcome the problem, since they often involve complicated and expensive circuitry and detection devices, mounted in the exhaust vents or in a floor mat adjacent the cooking area and are susceptible to damage from grease fires and spills which can occur in a cooking area.

It is seen then that a need exists for an exhaust ventilation system wherein the exhaust requirements are matched to the cooking load.

SUMMARY OF THE INVENTION

This need is met by the exhaust control system of the present invention wherein the exhaust fans of the ventilation system are interlocked with a cooking area monitoring means and power control circuit to electrically and/or mechanically control the speed and/or number of fans which are caused to operate in response to the number of cooking areas that are in operation. Particularly, the fan speeds are electro-mechanically interlocked with the cooking area, which area may include one or more burners, one or more grills, one or more griddles, and/or one or more fryers. The system may further include a time delay to discontinue operation of the fans a predetermined time period after operation of the cooking areas is discontinued. Finally, the system may include an override feature wherein a user can select speeds and times in order to overrule the control system.

The exhaust ventilation control system of the present invention comprises: at least one cooking area for cooking food; at least one exhaust fan for exhausting air from the cooking areas to an external environment; exhaust control means connected to the exhaust fans for controlling operation of the exhaust fans in response to operation of the cooking areas. In various embodiments of the invention, the cooking area comprises one or more grills, one or more burners, and/or one or more fryers. In addition, the system includes one exhaust fan located above the cooking area.

In another embodiment of the invention, the exhaust ventilation control system is used with a ventilation system located at a cooking station, the cooking station including one or more cooking areas and the ventilation system including a hood positioned over the cooking area and having one or more exhaust fans, each exhaust fan having a motor, for exhausting air containing cooking by-products from the cooking station to an external environment through a duct. In this embodiment, the exhaust ventilation control system comprises: exhaust control means connected to the exhaust fans for controlling operation of the exhaust fans in response to operation of the cooking areas, the exhaust control means including, cooking area monitoring means for monitoring which of the one or more cooking areas is in operation, and a power control circuit responsive to the cooking area monitoring means for controlling power supplied to the exhaust fan motors.

In a preferred embodiment, the exhaust control means further includes a timer delay circuit responsive to the cooking area monitoring means for maintaining the power supplied to the exhaust fans for a predetermined period of time after operation of all of the cooking areas is terminated, to remove residual cooking by-products to the external environment. In addition, the exhaust control means may further include override means for permitting a user to select exhaust fan speeds and operation times to override the exhaust ventilation control system.

In a further embodiment of the present invention, the exhaust ventilation control system is used with a ventilation system located at a cooking station, the cooking station including one or more cooking areas and the ventilation system including a hood positioned over the cooking area and having one or more exhaust fans, each exhaust fan having a motor, for exhausting air containing cooking by-products from the cooking station to an external environment through a duct. The exhaust ventilation control system of this embodiment comprises: exhaust control means connected to the exhaust fans for controlling operation of the exhaust fans in response to operation of the cooking areas. The exhaust control means include cooking area monitoring means for monitoring which of the one or more cooking areas is in operation, a power control circuit responsive to the cooking area monitoring means for controlling power supplied to the exhaust fan motors, a timed switch operable in response to the power control circuit to switch to a first position when one of the cooking areas is in operation and further operable to switch to a second position when two of the cooking areas are in operation and further operable to switch to a third position when three of the cooking areas are in operation and further operable to switch to a fourth position when operation of all of the cooking areas is terminated.

In a preferred embodiment, the exhaust control means further includes a timer delay circuit responsive to the cooking area monitoring means for maintaining the power supplied to the exhaust fans for a predetermined period of time after operation of all of the cooking areas is terminated, to remove residual cooking by-products to the external environment. In addition, the exhaust control means may further include override means for permitting a user to select exhaust fan speeds and operation times to override the exhaust ventilation control system. Finally, the first position of the timed switch is preferably a low speed; the second position of the timed switch may be either a low speed or a high speed; the third position of the timed switch is preferably a high speed; and the fourth position of the timed switch is preferably an off position.

It is object of the present invention to provide a system for controlling an exhaust fan above a cooking area, such as in a restaurant or institutional kitchen. It is a further object of the invention to provide such a system which controls the number of exhaust fans which are caused to operate in response to the number of cooking areas which are in operation. Also, it is an object of the invention to provide such a system for controlling the speed with which the exhaust fans exhaust air. Finally, it is an object of the present invention to provide such a system wherein the exhaust requirements are matched to the cooking load.

Other objects and advantages of the invention will be apparent from the following description, the accompanying drawings, and the appended claims.

DETAILED DESCRIPTION OF THE INVENTION

The present invention relates to a control system for controlling an exhaust fan above a cooking area, such as in a restaurant or institutional kitchen. The control system controls the number and the speed of fans in operation in response to the number of cooking areas which are in operation, by interlocking the operation of the exhaust fans with the operation of the cooking areas. Consequently, the signal indicating that a cooking area is in operation becomes an input to control the fan or fans of the exhaust ventilation control system. The control system may further include a time delay for adjusting operation of the exhaust fans, as well as a user override feature wherein the user may select speeds and times of operation of the exhaust fans in order to override the control system. Finally, the system of the present invention has the advantage of reducing the heating, ventilation, and air conditioning costs of the user.

Figure 1:
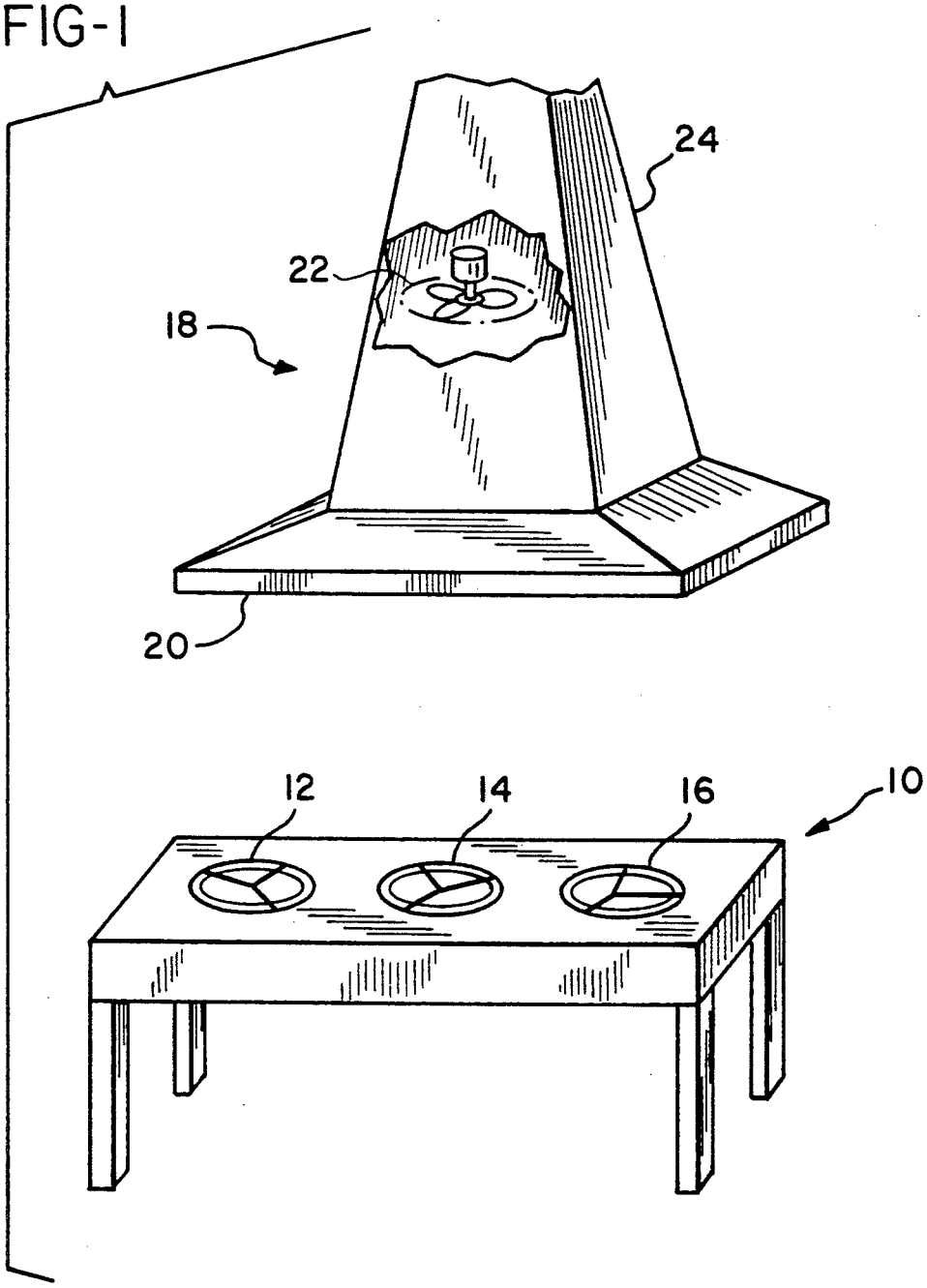
FIG. 1 is a block diagram illustrating the interrelationship between the exhaust fans and the cooking areas of the exhaust ventilation system employing the exhaust ventilation control system of the present invention.

Referring now to the drawings and particularly to FIG. 1, reference number 10 generally refers to a cooking area. In this embodiment, the cooking area 10 includes three burners 12, 14, and 16. Above the cooking area 10 is an exhaust ventilation system 18 including a vented hood 20 extending over the cooking areas 12, 14, and 16, and an exhaust means comprising one or more exhaust fans 22, each fan 22 having a motor for drawing smoke and the like from the vented hood 20 and up through ventilation ducting 24 to the exterior of the building. The vented hood 20 is shown partially cut away to expose one of the fans 22.

Figure 2:
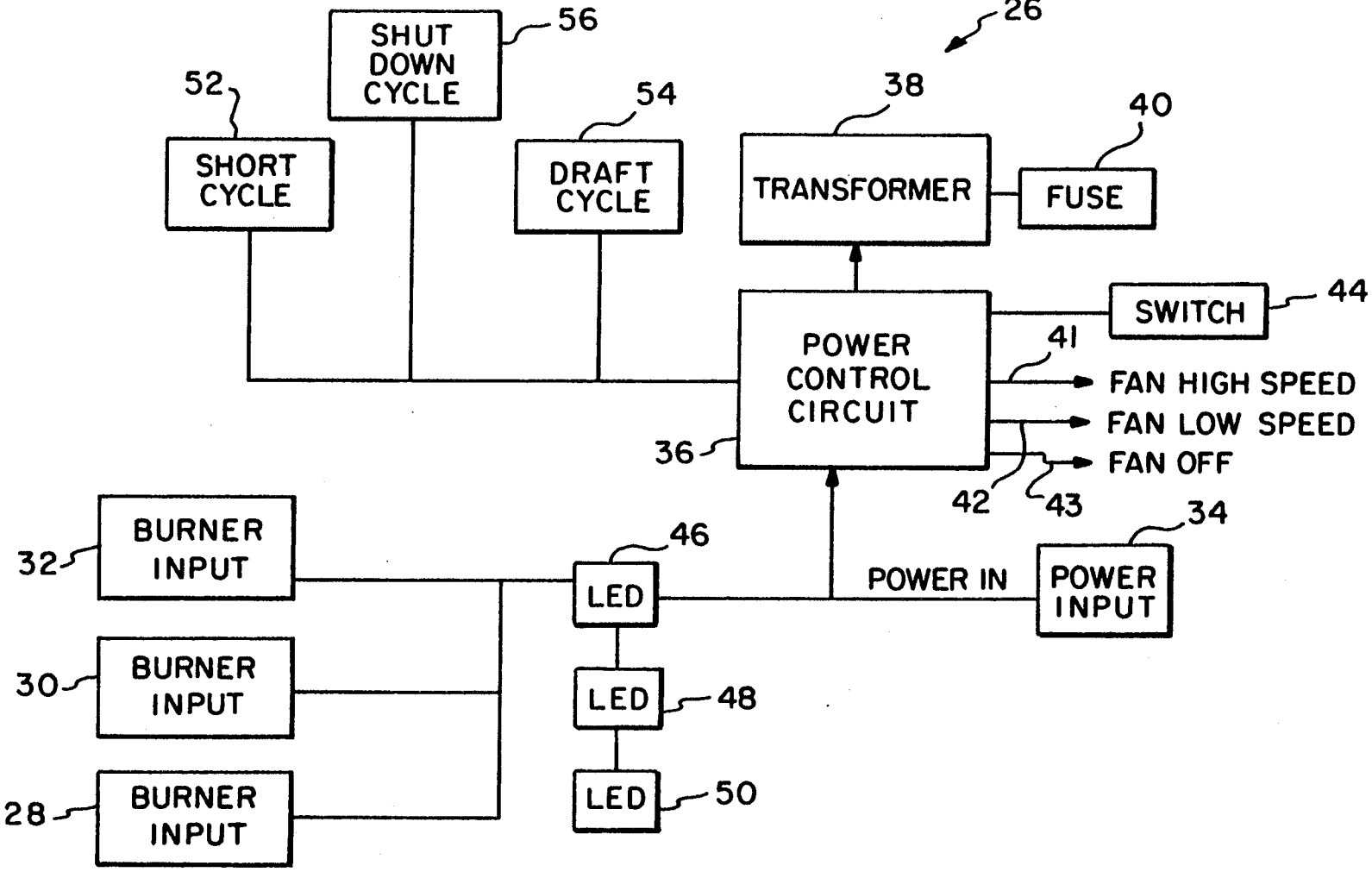
FIG. 2 is a schematic block diagram of the circuit logic of the exhaust ventilation control system of the present invention.

The exhaust ventilation control system of the present invention reduces the unnecessary running time for the exhaust fan 22 and the associated increased energy consumption of the system air conditioning the interior of the building. In addition, the exhaust ventilation control system controls the number of exhaust fans 22 which are caused to operate as well as the speed with which they exhaust air. The circuit for accomplishing this is illustrated in FIG. 2 as a schematic block diagram 26. The block diagram 26 matches the exhaust requirements to the cooking load.

The block diagram 26 includes a cooking area monitoring means shown as three burner inputs 28, 30, and 32 capable, in a preferred embodiment, of accepting 24 or 120 volts ac. The inputs 28, 30, and 32 indicate whether burners 12, 14, and 16, respectively, are turned on. If the burners 12, 14, and 16 are off, this is indicated by a zero volts ac signal. The block diagram further includes a power input 34 for inputting 120 volts ac to a power control unit 36. The power control unit 36 is operatively connected to a transformer 38 which has a fuse 40 in series with the line side of the power input. The power control unit 36 includes fan 22 speed outputs 41, 42, and 43 for indicating fan high speed, fan low speed, and fan off, respectively. In one embodiment of the invention, the system can also include a spare fuse (not shown).

In one embodiment of the present invention, a switch means can be provided for forcing the fan 22 to run at high speed, regardless of other inputs, in the event of manual deactivation of the exhaust ventilation control system. In a preferred embodiment of the exhaust ventilation control system of the present invention, the block diagram 26 includes three indicator lights, such as light emitting diodes (LEDs) 46, 48, and 50, for indicating power on, fan high speed, and fan low speed, respectively. A timed switch 44 operates in response to the power control circuit to switch to a first position or low speed indicated by LED 50 when one or two of the burners 12, 14, or 16 is in operation; a second position which may be a low or a high speed at either LED 50 or LED 48, when two or more of the burners 12, 14, and 16 are in operation; a third position or high speed indicated by LED 48 when three or more of the burners are in operation; and a fourth position or off position when operation of all of the burners 12, 14, and 16 is terminated. The fan speed output is indicated by power control unit 36 outputs 41, 42, and 43.

During normal operation of the exhaust ventilation control system of the present invention, if one of the burners 12, 14, or 16 is on, the fan 22 will be on low speed, which will be indicated by LED 50. If two or more of the cooking areas 12, 14, and 16 are on, the fan 22 will be operating on high speed, which will be indicated by LED 48. Alternatively, if one or two of the cooking areas 12, 14, and 16 are on, the fan 22 will be operating on low speed, which will be indicated by LED 50; while if three or more cooking areas are operating, the fan 22 will be operating at high speed, which will be indicated by LED 48. A short cycle sequence of events can be employed to prevent the fans 22 from immediately reacting to a change in the number of cooking areas operating. In the short cycle sequence at block 52, the fan 22 motor is prevented from short cycling by pausing for a predetermined time period, such as 0 to 30 seconds, before changing the speed or number of fans in operation. This permits the cooking equipment to be turned on and off in quick succession without simultaneously affecting the fan operation, such as when the cooking equipment operator accidently affects operation of a cooking area, or otherwise immediately changes his or her mind after turning a cooking area off and quickly turns the cooking area on again.

When all cooking areas 12, 14, and 16 are in an off state and then at least one cooking area 12, 14, or 16 is turned on, a draft cycle sequence of events begins. In the draft cycle at block 54 of FIG. 2, the sequence begins when a cooking area or burner 12, 14 or 16 is turned on and registered at a burner input 28, 30, or 32. The fan 22 turns on at high speed, which will be indicated at LED 48, for a user selected or preselected time interval to ensure proper hood 20 drafts during cooking area startup. At the end of the draft cycle 54, the fan 22 will revert to a normal operating condition, as described above. However, if all of the burners 12, 14 and 16 are turned off during the draft cycle, the short cycle sequence need not be initiated.

After the draft cycle at block 54 is complete, any change in the number of burner inputs 28, 30, and 32 activated will cause a change in the fan 22 speed control. If the change indicates that additional burners have been turned on, the fan 22 speed will immediately be adjusted to reflect the proper speed for the new number of operating burners 12, 14, and 16. If the change indicates a reduction in the number of active burners 12, 14, or 16, then a predetermined time delay period will be initiated by a time delay means. If the time delay period expires while the burner inputs 28, 30, and 32 still indicate a change in fan 22 speed, then the fan 22 speed outputs will reflect the new fan speed requirements. Finally, if the burner inputs 28, 30, and 32 return to a state consistent with the current fan 22 speed prior to the end of the time delay, then the time delay will be canceled and the fan 22 speed will remain the same.

Once all of the burners 12, 14 and 16 are turned off, a shut down sequence of events begins at block 56. In this sequence, the short cycle sequence at block 52, as described above, will be initiated. At the end of the short cycle sequence, assuming that all of the burners 12, 14, and 16 remain off, the shut down sequence continues by permitting the fan 22 to continue to run at its previous speed for a predetermined interval. At the end of this predetermined interval, the fan 22 output will shut down power to the fan 22.

Having described the invention in detail and by way of reference to preferred embodiments thereof, it will be apparent that modifications and variations are possible without departing from the scope of the invention which is defined in the appended claims.

What is claimed is:

1. An exhaust ventilation control system for use with a ventilation system located at a cooking station, the cooking station including one or more cooking areas and the ventilation system including a hood positioned over the cooking station and having one or more exhaust fans, each exhaust fan having a motor, for exhausting air containing cooking by-products from the cooking station to an external environment through a duct, the exhaust ventilation control system comprising:

exhaust control means connected to the exhaust fans for controlling operation of the exhaust fans in response to the number of said cooking areas which are in operation, the exhaust control means including, cooking area monitoring means for monitoring which of the one or more cooking areas is in operation and monitoring power input to each said cooking area, and power control circuit means responsive to said cooking area monitoring means for controlling power supplied to the exhaust fan motors responsive to the number of cooking areas in operation as detected by said monitoring means.

2. An exhaust ventilation control system as claimed in claim 1 wherein said exhaust control means further includes a time delay means responsive to said cooking area monitoring means for maintaining said power supplied to the exhaust fans for a predetermined period of time after operation of all of the cooking areas is terminated, to remove residual cooking by-products to the external environment.

3. An exhaust ventilation control system as claimed in claim 1 wherein said exhaust control means further includes override means for permitting a user to select exhaust fan speeds and operation times to override the exhaust ventilation control system.

4. An exhaust ventilation control system for use with a ventilation system located at a cooking station, the cooking station including one or more cooking areas and the ventilation system including a hood positioned over the cooking area and having one or more exhaust fans, each exhaust fan having a motor, for exhausting air containing cooking by-products from the cooking station to an external environment through a duct, the exhaust ventilation control system comprising:

exhaust control means connected to the exhaust fans for controlling operation of the exhaust fans in response to operation of the cooking areas, the exhaust control means including, cooking area monitoring means for monitoring which of the one or more cooking areas is in operation, a power control circuit responsive to said cooking area monitoring means for controlling power supplied to the exhaust fan motors, a timed switch operable in response to said power control circuit to switch to a first position when one of the one or more cooking areas is in operation and further operable to switch to a second position when two of the one or more cooking areas are in operation and further operable to switch to a third position when three or more of the one or more cooking areas are in operation and further operable to switch to a fourth position when operation of the one or more cooking areas is terminated.

5. An exhaust ventilation control system as claimed in claim 4 wherein said exhaust control means further includes a timer delay circuit responsive to said cooking area monitoring means for maintaining said power supplied to the exhaust fans for a predetermined period of time after operation of all of the cooking areas is terminated, to remove residual cooking by-products to the external environment.

6. An exhaust ventilation control system as claimed in claim 4 wherein said exhaust control means further includes override means for permitting a user to select exhaust fan speeds and operation times to override the exhaust ventilation control system.

7. An exhaust ventilation control system as claimed in claim 4 wherein said first position of said timed switch is a low speed.

8. An exhaust ventilation control system as claimed in claim 4 wherein said second position of said timed switch is a low speed.

9. An exhaust ventilation control system as claimed in claim 4 wherein said second position of said timed switch is a high speed.

10. An exhaust ventilation control system as claimed in claim 4 wherein said third position of said timed switch is a high speed.

11. An exhaust ventilation control system as claimed in claim 4 wherein said fourth position of said timed switch is an off position.

* * * * *